United States Patent [19]

Crowley

[11] Patent Number: 4,776,588

[45] Date of Patent: Oct. 11, 1988

[54] COIN OR TOKEN-OPERATED TENNIS NET

[76] Inventor: Joseph R. Crowley, 3430 Kindred Ave., 39 Moana Apts., Reno, Nev. 89502

[21] Appl. No.: 13,178

[22] Filed: Feb. 9, 1987

Related U.S. Application Data

[63] Continuation of Ser. No. 747,708, Jun. 24, 1985, abandoned.

[51] Int. Cl.[4] ..... G07F 5/10

[52] U.S. Cl. ..... 273/29 BB

[58] Field of Search ..... 273/29 A, 29 B, 29 BB, 273/29 BC, 29 BD, 30

[56] References Cited

U.S. PATENT DOCUMENTS

| | | | |
|---|---|---|---|
| 1,998,454 | 4/1935 | Gordon | 273/29 BB |
| 2,159,633 | 5/1939 | Petersen | 273/29 BB |
| 2,177,689 | 10/1939 | Dalkin . | |
| 2,794,869 | 6/1957 | Noregaard . | |
| 2,884,252 | 4/1959 | Thompson | 273/55 D |
| 2,918,158 | 12/1959 | Shlank . | |
| 3,153,469 | 10/1964 | McPherson . | |
| 3,211,267 | 10/1965 | Bayha . | |
| 3,645,370 | 2/1972 | Rodwell et al. | 273/29 BB |
| 3,961,789 | 6/1976 | Tabacheck | 273/29 BE |
| 3,995,854 | 12/1976 | Gasaway | 273/29 BB |

FOREIGN PATENT DOCUMENTS

| | | | |
|---|---|---|---|
| 2424592 | 11/1979 | France | 273/29 BB |
| 2912528 | 1/1980 | Fed. Rep. of Germany | 273/29 BB |
| 2912528 | 9/1980 | Fed. Rep. of Germany | 273/29 BD |

*Primary Examiner*—Richard C. Pinkham
*Assistant Examiner*—T. Brown
*Attorney, Agent, or Firm*—Gifford, Groh, VanOphem, Sheridan, Sprinkle and Dolgorukov

[57] ABSTRACT

A coin- or token-operated game duration controller for a game utilizing a net stretched across a court between a pair of posts. The controller is attached to one of the posts and comprises an electrically driven winch winding and unwinding the net cord cable for raising the net at the beginning of a game period and for lowering the net at the end of a game period. The electric motor is controlled by a coin or token operated switch and timer. The invention requires no modification or alteration of conventional existing net support posts.

4 Claims, 1 Drawing Sheet

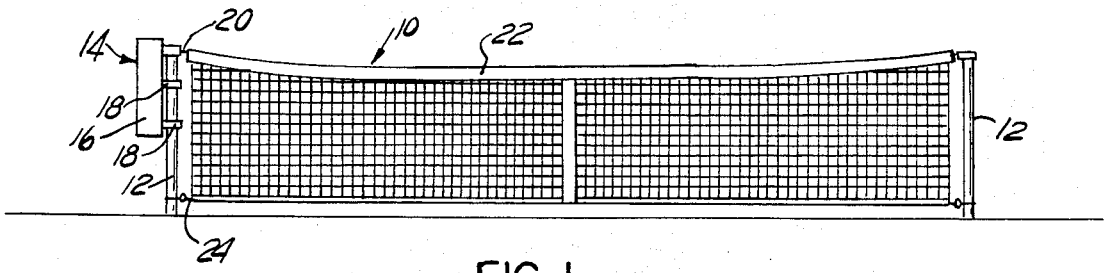
FIG. 1
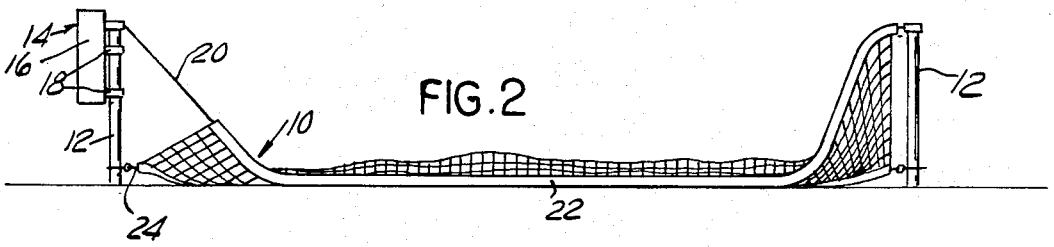
FIG. 2
FIG. 3
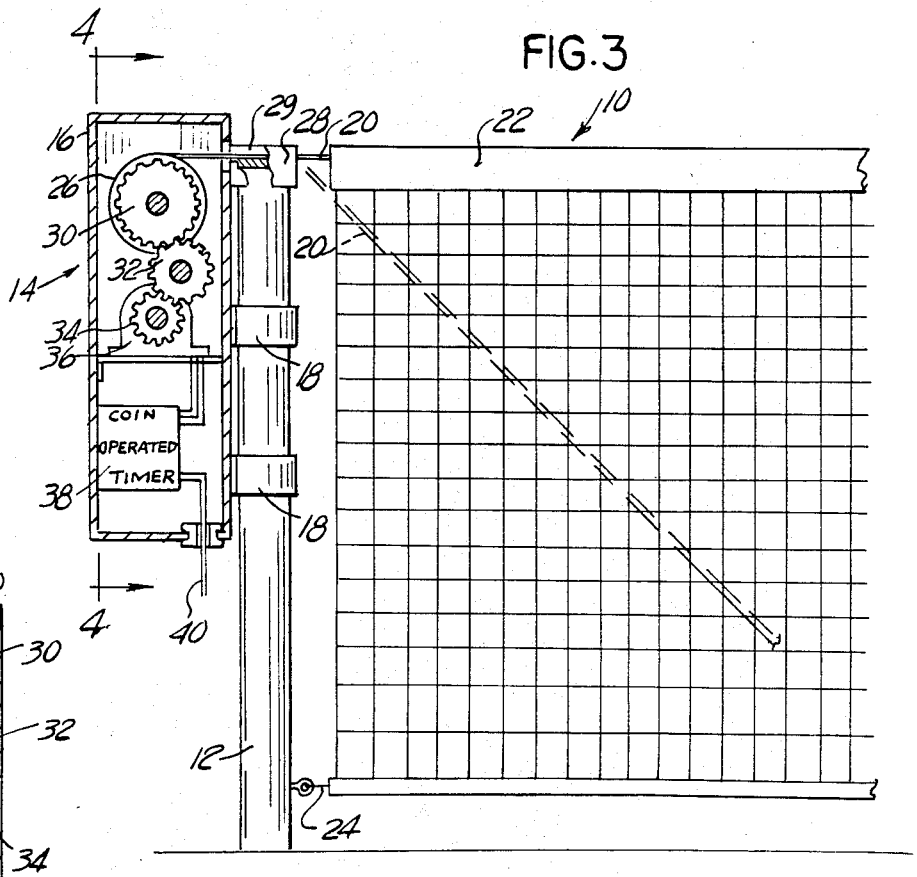
FIG. 4
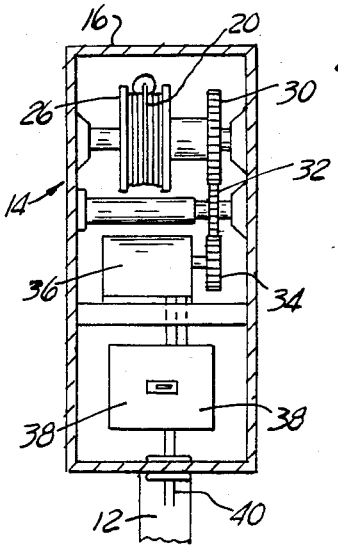

COIN OR TOKEN-OPERATED TENNIS NET

This application is a continuation application of Ser. No. 747,708, filed June 24, 1985 (now abandoned).

BACKGROUND OF THE INVENTION

The present invention relates to coin- or token-operated tennis nets in general, and more particularly to a tennis net which is raised to its playing position upon insertion of a coin token or card in a control box, and which is automatically lowered after a predetermined period of playing time.

Sports, such as tennis or volleyball for example, make use of a net which is stretched between two support posts on a court. Commercial utilization of such courts requires that an attendant be present to collect fees according to the duration of use of the courts by players.

Such sports, tennis or volleyball, require that the net be stretched at a predetermined regulation height, and if the net is too high or too low relative to the regulation height, normal play is prevented. More particularly, if the net is completely lowered, there is no possibility of a normal play taking place.

Devices have been proposed in the past for automatically raising a playing net, such as used in tennis or volleyball for example, upon insertion of a coin or token in an appropriate controlling component. After a predetermined period of time, the net is automatically lowered. By way of such a device, money for the use of the courts may be collected without the presence of an attendant for collecting the fees and timing of the use of the courts.

Applicant is aware of the existence of the following prior art:

U.S. Pat. No. 3,995,854 disclosing telescopic support posts for a net, which are extended by a lift mechanism upon the insertion of coins in a controlling component. The posts are automatically lowered under the control of a timing mechanism at the end of a predetermined time period.

U.S. Pat. No. 1,998,454 also disclosing a mechanism for raising and lowering a net. The mechanism takes the form of a pair of electric motor-driven screwjacks disposed each in one of the posts and supporting the net or, in the alternative, consists of a hydraulic jack in each post for raising and lowering the net.

U.S. Pat. No. 3,645,370 which discloses a hydraulically operated ram which is connected to the support cord of a net such that the net is raised when the ram is extended and lowered when the ram is retracted. The ram is extended by a manually operable pump, and a coin-operated mechanism sets a timing device which opens a valve after a predetermined time period, thus permitting the ram to retract under the weight of the net.

French Patent Publication No. 2,424,592 disclosing a net raising and lowering mechanism of the screwjack type driven by an electric motor controlled by the insertion of a coin.

German Patent Publication No. 2,912,528 disclosing a winch around which a net support cord is wound, and a manually-operated lever and ratchet mechanism for driving the winch, such that the net may be manually raised. An electromagnetic clutch is mounted between the ratchet mechanism and the winch, and the energization of the electromagnets after a predetermined period of time releases the winch, thus allowing drop of the net by gravity.

Such devices, as presently known, of the prior art present the disadvantages of usng complex mechanisms, electrical or hydraulic, of achieving raising and lowering of a net by way of telescoping posts, by way of screwjacks requiring the posts to be slotted or, according to the disclosure of the German patent publication No. 3,645,370, requiring manual raising of the net. All known devices of the prior art require that conventional net support posts be replaced by posts specifically designed for the purpose, or be substantially modified to accept the net raising and lowering mechanism.

SUMMARY OF THE INVENTION

The present invention remedies the shortcomings and inconveniences of the known prior art by providing a simple mechanism for raising a playing net such as, for example, a tennis net, by action upon the cord cable supporting the net only, without requiring the use of telescopic support posts, screwjacks, hydraulic rams or electromagnets. More particularly, an object of the invention is to provide a mechanism for raising and lowering a net under the control of a coin-, token- or encoded card-operated mechanism, which requires no modification of conventional net supporting posts, which is simple in structure and of low cost, that requires very little maintenance, if any, and which does not require that components be installed in the support posts or that the support posts be replaced.

The many objects and advantages of the present invention will become apparent to those skilled in the art when the following description of the best mode contemplated for practicing the invention is read in conjunction with the accompanying drawing wherein:

BRIEF DESCRIPTION OF THE DRAWING

FIG. 1 is a schematic representation of a raised tennis net, for example, operable by the net control device of the invention;

FIG. 2 is a schematic representation thereof showing the net in a lowered position;

FIG. 3 is a schematic section showing the net raising and lowering mechanism of the invention; and FIG. 4 is a view thereof from line 4—4 of FIG. 3.

DETAILED DESCRIPTION OF THE PREFERRED EMBODIMENT

Referring now to the drawing, and more particularly to FIGS. 1 and 2 thereof, a play net such as a tennis net 10, for example, is illustrated in a raised position stretched between a pair of conventional support posts 12, FIG. 1, and in a lowered position, FIG. 2. The raising and lowering of the net 10 is effected by means of the mechanism of the invention, generally designated at 14, which is enclosed in a housing 16 appropriately clamped to only one of the posts 12 by means such as conventional clamping rings 18. The net 10 is supported at its top margin by a cord cable 20 passed through a hem or gusset 22 formed or attached to the net at its top edge, the net 10 being pulled down, as is customary, by a cable 24 attached at both ends to the bottom of a post 12.

As best shown at FIGS. 3 and 4, a winch or drum 26 is rotatably supported, transversely, in the housing 16, and the end of the cord cable 20 is attached to the drum 26 such as to wind therearound and unwind therefrom according to the direction of rotation of the drum. The post 12, which is generally tubular, is closed on its top by a cap 28 provided with a groove 29 for supporting and guiding the cord cable 20 in combination with a conventional cord cable tensioning mechanism, the cap 28 is left in its usual position such that the cord cable 20 passes over the cap 28 in the groove 29. In rare installations wherein there is no grooved cap mounted on the top of the support post 12, installation of such a grooved cap, or installation of a pulley 28 is the only modification required to a post to allow installation thereon of the net raising and lowering mechanism 14 of the invention.

The drum 26 may be directly driven in rotation by an electric motor, but, preferably, it is provided with a toothed wheel 30 meshing with an intermediary gear 32 in turn meshing with a pinion 34 coupled to the output shaft of a reversible electric motor 36. In this manner, an appropriate force amplification is provided in the drive from the output shaft pinion 34 of the electric motor 36 to the drum 26, permitting to use a low power and therefore relatively low cost electric motor 36. The gear train consisting of the pinion 34, the intermediary gear 32 and the toothed wheel 30, in addition to providing power amplification, and to permitting to drive the winch or drum 26 in either direction in a substantially irreversible fashion, prevents the output shaft pinion 34 of the electric motor 36 to be driven from the drum 26 under the weight of the net 10, for an appropriate high gear ratio. If so desired, the coupling between the electric motor output shaft pinion 34 and the drum 26 may be effected through a worm and gear coupling providing irreversible drive for an appropriate gear ratio, such as in excess of 1 to 10.

The operation of the electric motor 36 is controlled by a coin- or token-operated switch and timer 38 of conventional structure or, in the alternative, according to the token card-operated control apparatus disclosed and claimed in copending application Ser. No. 748,170, filed contemporaneously herewith. Electric power is supplied to the coin- or token- operated switch and timer 38 by an electric line 40 connected to an appropriate electrical outlet, and upon insertion of a coin or token into the slot of the coin- or token- operated switch and timer 38, the electric motor 36 is activated such as to drive the drum 26 in the appropriate direction of rotation winding the cord cable 20 around the drum 26 such as to stretch the cord cable and raise the net 10 from the position shown at FIG. 2 to the position shown at FIG. 1. After a predetermined period of elapsed time, as determined by the amount of coins or tokens deposited in the coin- or token- operated switch and timer 38, the electric motor 36 is activated in a reverse direction such as to lower the net 10 from the position shown at FIG. 1 to the lowered position shown at FIG. 2.

Limit switches, or torque switches may be provided for stopping the electric motor 36 when the net 10 has been raised to an appropriate position or, in the alternative, the torque developed by the electric motor 36 may be limited to a predetermined value causing stalling of the motor when the net 10 is being fully raised, and appropriate relays provided for shutting off the motor upon stalling. The duration of activation of the electric motor 36 in a reverse direction for lowering the net 10 may also be limited by limit switches, torque switches or by a timer.

Having thus disclosed the present invention by way of an example of structure well adapted to accomplish the objects of the invention, modification whereof will be apparent to those skilled in the art.

What is claimed as new is as follows:

1. A self contained game duration controller for a conventional game utilizing a net stretched across a court between a pair of substantially parallel stationary posts, said net being supported at a top edge between said posts by means of a cord cable, said cord cable having an end fixedly attached to one of said posts, said controller requiring no modification to said posts but being readily adapted to said conventional net game, said controller comprising a housing means for attaching said housing to the other of said posts, a rotatable drum mounted in said housing for winding the other end of said cord cable therearound for raising said net and unwinding said other end of said cord cable for lowering said net, a reversible electric motor mounted in said housing, means driving said drum from said reversible electric motor, and a coin or token-operated switch and timer for controllably energizing said reversible electric motor for rotation in one direction upon insertion of a coin or token in said switch and timer for driving said drum in a direction of rotation that causes winding of said end of said cord cable around said drum for raising said net and for energizing said reversible electric motor for rotation in an opposite direction for driving said drum in an opposite direction of rotation unwinding said end of said cord cable from around said drum for lowering said net after a predetermined period of time.

2. The controller of claim 1 wherein said means driving said drum from said motor comprises gear drive means providing irreversibility of drive from said drum to said motor for preventing said motor from being driven by said drum.

3. The controller of claim 1 wherein said means driving said drum from said motor comprises at least one intermediary gear between said electric motor and said drum providing power amplification while driving said drum from said motor and irreversibility of drive from said drum to said motor for preventing said motor from being driven by said drum.

4. The controller as claimed in claim 1 further comprising:

a cap member mounted to said other of said pair of posts, said cap member having a horizontal groove adapted to slidably receive said other end of said cord cable.

* * * * *